US006152431A

United States Patent [19]

Stenz et al.

[11] Patent Number: 6,152,431

[45] Date of Patent: Nov. 28, 2000

[54] CARBURETOR HAVING EXTENDED PRIME

[75] Inventors: Dennis N. Stenz, Mt. Calvary; Thomas G. Klein, Lomira; Nicholas J. Caruso, De Pere, all of Wis.

[73] Assignee: Tecumseh Products Company, Tecumseh, Mich.

[21] Appl. No.: 09/302,002

[22] Filed: Apr. 28, 1999

Related U.S. Application Data

[60] Provisional application No. 60/084,431, May 6, 1998.

[51] Int. Cl.[7] ..... F02M 1/16

[52] U.S. Cl. ..... 261/34.1; 123/179.11; 261/DIG. 8

[58] Field of Search ..... 261/34.1, 72.1, 261/DIG. 8, DIG. 21, DIG. 67, DIG. 73; 123/179.9, 179.11, 437

[56] References Cited

U.S. PATENT DOCUMENTS

| | | | |
|---|---|---|---|
| 1,206,221 | 11/1916 | Hives | 123/179.11 |
| 1,327,430 | 1/1920 | Honold et al. | 123/179.11 |
| 1,384,429 | 7/1921 | Cole | 261/DIG. 8 |
| 1,562,806 | 11/1925 | Taylor | 261/41.5 |
| 2,744,736 | 5/1956 | Evinrude | 261/34.2 |
| 3,345,045 | 10/1967 | Tuggle | 261/34.1 |
| 3,780,996 | 12/1973 | Nutten | 261/72.1 |
| 3,872,851 | 3/1975 | Matsumoto et al. | 123/179.15 |
| 4,271,093 | 6/1981 | Kobayashi | 261/34.1 |
| 4,375,206 | 3/1983 | Baltz et al. | 261/DIG. 8 |
| 4,446,080 | 5/1984 | Karino et al. | 261/39.5 |
| 4,447,370 | 5/1984 | Kobayashi et al. | 261/35 |
| 4,498,434 | 2/1985 | Baltz et al. | 261/DIG. 73 |
| 4,542,723 | 9/1985 | Fujimoto | 261/DIG. 8 |
| 4,554,896 | 11/1985 | Sougawa | 261/DIG. 8 |
| 4,836,157 | 6/1989 | MIller | 123/179.11 |
| 4,926,808 | 5/1990 | Kandler | 123/179.11 |
| 5,058,544 | 10/1991 | Guntly et al. | 123/179.9 |
| 5,273,008 | 12/1993 | Ditter | 123/179.11 |
| 5,711,901 | 1/1998 | Berg et al. | 261/35 |
| 5,740,781 | 4/1998 | Scott et al. | 123/437 |

FOREIGN PATENT DOCUMENTS

| | | | |
|---|---|---|---|
| 1-147148 | 6/1989 | Japan | 261/DIG. 8 |
| 1-147149 | 6/1989 | Japan | 261/DIG. 8 |
| 1-151758 | 6/1989 | Japan | 261/DIG. 8 |
| 3-242455 | 10/1991 | Japan | 261/DIG. 8 |

*Primary Examiner*—Richard L. Chiesa
*Attorney, Agent, or Firm*—Baker & Daniels

[57] ABSTRACT

A carburetor having an extended prime fuel chamber for gasoline engines. The carburetor includes a carburetor body having a throat, a fuel bowl, a conduit extending from the fuel bowl to the throat, a variable volume primer chamber communicating with the bowl through a priming passage, and an extended prime fuel chamber. The extended prime fuel chamber delivers additional fuel from start-up through warm-up periods of the engine. The extended prime fuel chamber communicates with the throat extending to the engine and communicates with the bowl containing fuel. The extended prime fuel chamber is arranged such that, after activation of a priming bulb, fuel from the carburetor bowl is directed into the throat through a nozzle tube and also into the extended prime fuel chamber through a prime fill passage. Once the engine fires, the fuel in the extended prime fuel chamber then is also directed into the carburetor throat through an extended prime fuel passage disposed at a lower position in the extended prime fuel chamber than the point at which the prime fill passage connects to the extended prime fuel chamber.

16 Claims, 8 Drawing Sheets

CARBURETOR HAVING EXTENDED PRIME

CROSS-REFERENCE TO RELATED APPLICATION

This application is related to and claims the benefit under 35 U.S.C. §119(e) of Provisional Application Serial No. 60/084,431, filed May 6, 1998.

BACKGROUND OF THE INVENTION

The present invention relates to carburetors and in particular to carburetors for small gasoline engines, such as those used in the lawn and garden industry.

The necessity to meet emission levels required by government agencies such as CARB and the Environmental Protection Agency has resulted in the need to calibrate carburetors to operate under leaner conditions. Such leaner calibrations have caused most engines to start more poorly than the prior carburetors calibrated to produce a richer air-fuel mixture, and have been shown to cause false starts and surging during warm up from a cold start.

A temporary richer fuel delivery curve is required during these periods, but the simple fuel delivery system of current small engine carburetors do not compensate for such starting conditions. Furthermore, the primer systems of current small engine carburetors provide adequate fuel to start the engine, but the prime charge does not last long enough to carry the engine through warm up, even with repeated primes.

U.S. Pat. Nos. 2,744,736; 3,345,045; 5,058,544; 1,327,430; 1,206,221; and 1,562,806 disclose primer systems of small engine carburetors. For example, U.S. Pat. No. 5,058,544 discloses a floatless carburetor with an integral primer system which has a primer bulb with a primer chamber to introduce fuel directly into the carburetor throttle bore. This system may provide an adequate fuel charge to the engine for start up; however, the fuel charge from the primer chamber is sometimes not enough to last the engine through warm up, causing engine stalling, false starts and surging. Repeated fuel charges may be necessary in order to provide adequate fuel to last the engine through warm up.

U.S. Pat. No. 3,345,045 discloses a conventional carburetor with a priming system for an internal combustion engine. The carburetor has a float bowl with an air inlet above the fluid level. A flexible tube connects the interior of the float bowl with an air pumping device such as a flexible bellows. In order to provide a rich mixture needed for starting the engine, the bellows is manually depressed which increases pressure in the float bowl above atmospheric pressure causing a measured amount of fuel to flow from the float bowl upwardly through a fuel nozzle into a mixture passage. This system also may provide an adequate fuel charge to the engine for start up, but the provided rich mixture may not be enough to keep the engine running through the warm up period. Again, repeated fuel charges may be necessary.

Current small engine carburetors that have systems for priming through warm up are complex systems causing higher costs, having less durability, and possibly requiring additional activation of the primer. For example U.S. Pat. Nos. 4,836,157; 4,446,080; and 3,872,851 each disclose a carburetor with a priming system which includes electrical devices. U.S. Pat. No. 4,836,157 discloses a priming system which includes a temperature sensor connected to the engine and a pressure switch connected in the fuel line to provide signals to a priming control circuitry whenever fuel is pumped to the carburetor air intake. When signals exceed a selected threshold, an LED is driven by an oscillator to advise the operator to terminate the manual priming operation.

The inclusion of electronic devices to these priming systems results in undesirably high manufacturing costs and unnecessarily high maintenance costs. This is primarily due to the added time to manufacture the system and the costs of the electronic components. Additionally, with the implementation of electronic devices thereto, the durability of these small engines are limited by the constraints of the electronic devices. During normal operations of these systems, the user is required to be even more cognizant of the physical impacts endured by the engine due to the limiting factors of the electronic devices.

Current small engine carburetors that have systems for priming through warm up are dependent on parameters and/or conditions of the engine. For example, U.S. Pat. No. 3,780,996 discloses a self-priming chokeless carburetor having a throttle valve in the air-fuel mixture conduit supplemented by a priming well disposed serially between a fixed metering orifice communicating with a float bowl reservoir and an inlet to a main nozzle tube. However, the level of fuel in the priming well is dependent upon the level of fuel in the float bowl. Thus, the level in the priming well may or may not be adequate to last through engine warm up.

Current small engine carburetors that have systems for priming through warm up are complex systems manually operated. For example, U.S. Pat. No. 5,740,781 discloses a starting system constructed to utilize atmospheric air control feed back to a carburetor and includes a piston disposed with a chamber which accesses two atmospheric ports by manual selective movement of the piston. The system has a fuel prime arrangement which includes a primer pawl interconnected to the piston which depresses a prime bulb upon manual selective movement of the piston.

Thus it is desired to provide a simple primer system for small engine carburetors that provides an adequate amount of fuel to the engine for start up to last through warm up, but yet is low in cost, durable, and automated from engine start up through warm up.

SUMMARY OF THE INVENTION

The present invention overcomes the deficiencies of prior carburetors in a simple and cost effective manner by providing an extended prime fuel chamber which delivers additional fuel from start up through warm up periods of the engine. The extended prime fuel chamber is filled up to a certain level with fuel during the priming operation in the case of a primer-equipped carburetor, and during the choke period in the case of carburetors provided with a choke plate rather than a primer bulb or a combination of both. After startup, liquid fuel is drawn out of the extended prime fuel chamber into the throat of the carburetor until the extended prime reservoir is empty, thereby providing enrichment during engine warm up. Once the extended prime reservoir is empty, the carburetor functions in the conventional fashion.

The present invention provides for a carburetor having an extended prime fuel chamber which communicates with the carburetor throat extending to the engine and communicates with a carburetor bowl containing fuel. The extended prime fuel chamber is arranged such that, upon activation of the primer bulb, fuel from the carburetor bowl is directed into the carburetor throat through a nozzle tube and also into the extended prime fuel chamber through a prime fill passage. Once the engine fires, the fuel in the extended prime fuel chamber then is also drawn into the carburetor throat through an extended prime fuel passage disposed at a lower position in the extended prime fuel chamber than the point at which the prime fill passage connects to the extended prime fuel chamber.

The extended prime only functions when activated by the starting enrichment system such as a priming bulb which, when repeatedly depressed, directs a volume of air therefrom into the carburetor bowl which, in turn, experiences an increase in pressure such that fuel is directed into the extended prime fuel chamber. The length of the enrichment period is controlled by adjusting singularly or in combination the reservoir size, reservoir feed source or metering orifice(s).

An advantage to the present invention is that it is a simple carburetor for effectively priming small engines through warm up. Another advantage is that the present invention has low manufacturing, parts, and labor costs. Yet another advantage is that the present invention is easy to use and is at least as durable as current small engine carburetors.

Furthermore, with respect to priming, the present invention is relatively automated after the engine is fired. After the engine is fired, fuel from the extended prime fuel chamber and the carburetor bowl enters the carburetor throat. The fuel in the extended prime fuel chamber lasts through engine warm up without requiring further priming.

DETAILED DESCRIPTION

Figure 1:
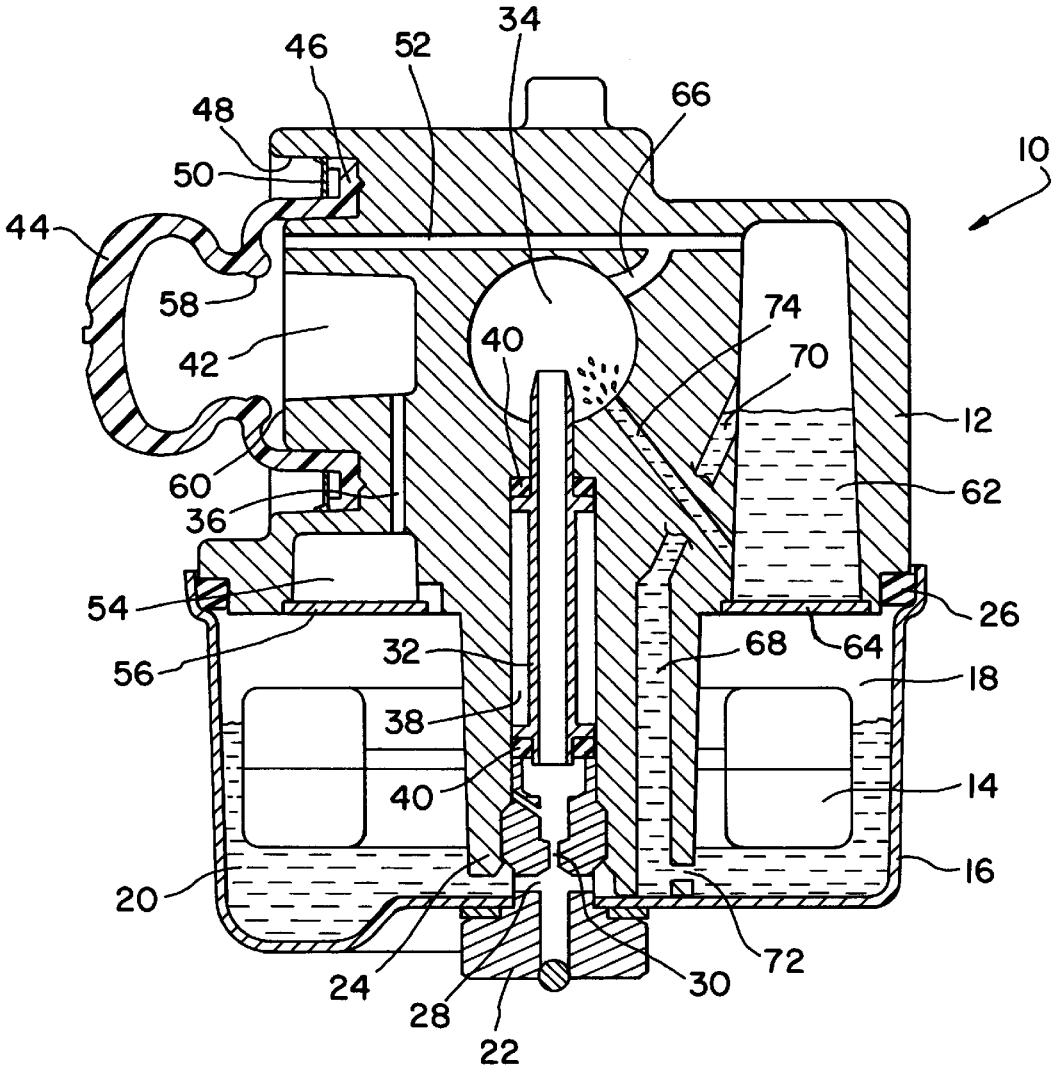
FIG. 1 is a sectional view of a carburetor illustrating a first embodiment and showing functional members thereof.

Referring now to the drawings, and in particular to FIG. 1, there is shown a first embodiment of a carburetor 10 for providing a combustible fuel/air mixture to a conventionally aspirated internal combustion engine, such as the type of engine used in lawn and garden applications such as lawnmowers, tillers and lawn and garden tractors. Carburetor 10 is generally similar to the carburetor disclosed in U.S. Pat. No. 4,926,808, which patent is incorporated herein by reference, but which has been further modified to include the extended prime feature that is the subject of the present application. Carburetor body 12 has a fuel inlet passage (not shown) for admitting fuel to the carburetor by gravity flow or by way of a fuel pump and a fuel inlet valve arrangement (not shown) regulated by means of float 14 disposed in carburetor bowl 16. The regulation of fuel flow to the carburetor 10 is accomplished in a conventional manner, such as shown in the aforementioned U.S. Pat. No. 4,926,808. Air space 18 occupies the volume of bowl 16 above the level of fuel 20. Float bowl 16 is connected to carburetor body 12 by means of bowl nut 22 that forms a threaded connection with the hollow columnar portion 24 of carburetor body 12. An O-ring seal 26 seals the connection between bowl 16 and carburetor body 12.

Fuel 20 from bowl 16 is introduced into carburetor body 12 through orifices 28 and 30 in carburetor nut 22. A conduit or nozzle tube 32 conveys fuel upwardly into the fuel/air mixture passage at carburetor throat or venturi 34 because of the lower pressure that exists in the region of venturi 34 compared to that in fuel bowl 16. During normal engine operation, when air flows through the constricted portion of venturi 34, it is at a lower pressure than atmospheric pressure, and at the same time, the pressure in air space 18 directly above fuel 20 is at essentially atmospheric pressure. Air space 18 remains at essentially atmospheric pressure as a result of the internal venting of the carburetor achieved by bowl vent 36. The fuel that is drawn upwardly is mixed with air, enters the airstream in the carburetor throat 34 and from there is drawn into the engine during normal operation. The nozzle tube 32 is sealed against carburetor nut 22 and the bore 38 of columnar portion 24 by means of O-rings 40.

In order to prime the engine, carburetor body 12 is provided with a cavity 42 over which a resilient primer bulb 44 is disposed, bulb 44 being manually compressible and made of a resilient rubber-like material, forming a variable volume primer chamber. Bulb 44 includes an annular flange 46 disposed in annular recess 48 and retained therein by means of a conventional retaining ring 50. The variable volume primer chamber formed by the interior space of primer bulb 44 and cavity 42 communicates with the carburetor throat through internal breather vent passage 52 and throat vent passage 66, which may be formed by a drilled and/or cast passage to the peripheral outer portion of the variable volume primer chamber. Thus, when bulb 44 is in its static state as shown in FIG. 1, the air space within bowl 16 is vented internally to the carburetor throat through chamber 54 separated from air space 18 by a Welch plug 56, bowl vent passage 36, chamber 42 and internal breather vent passage 52 and throat vent passage 66. Throat vent passage 66 extends to a larger diameter portion of the carburetor throat at a higher pressure than is present in venturi 34.

The primer bulb 44 has an annular lip 58 disposed along an inner portion of bulb 44 and which is situated opposite the surface 60 of the primer limiter boss. During a priming operation of carburetor 10, primer bulb 44 is depressed repeatedly by the operator, and when annular lip 58 engages surface 60, lip 58 acts as a valve to close off internal breather vent passage 52 from the variable volume primer chamber so that as the operator continues to depress bulb 44, a discrete volume of air is displaced through the bowl vent passage 36, which now functions as a priming passage, into air space 18. The increase in pressure generated in air space 18 by this displaced volume of air acts upon fuel 20 in bowl 16, thereby causing it to be forced upwardly through orifices 28 and 30, through nozzle tube 32, and into venturi 34 in order to form a rich fuel/air mixture that is drawn into the intake of the engine to aid in starting of the engine. The sealing off of vent passage 52 by lip 58 prevents a loss of the priming charge through this passageway and ensures that substantially all of the priming charge passes into air space 18 in order to force fuel upwardly into the venturi 34.

In accordance with the present invention, an extended prime fuel chamber 62 is formed in carburetor body 12 and is segregated from carburetor bowl 16 by means of a Welch plug 64, for example. Extended prime fuel chamber 62 communicates with venturi 34 through an extended prime fuel passage 74 and communicates with the carburetor bowl 16 through throat vent passage 66 via vent 52, cavity 42, bowl vent passage 36 and bowl chamber 54. Chamber 62 also communicates with the lower portion of the carburetor bowl 16 through a pair of interconnected fuel fill passages 68 and 70 and a metering orifice 72. It should be noted that passage 70 connects to extended prime fuel chamber 62 at a position in the upper portion of chamber 62. Extended prime fuel passage 74 extends from a lower portion of chamber 62 into carburetor throat 34.

In operation, pressing the primer bulb 44 pressurizes float bowl 16 in the manner previously described. During five repeated depressions of bulb 44, for example, fuel will travel into the metering orifice 72 and up fuel fill passage 68 as well as up through the nozzle tube 32. The size of orifice 72 allows an equal amount of fuel to be forced up nozzle tube 32 and fuel fill passage 68, and although the amount of fuel that is forced up through nozzle tube 32 is less than a typical existing carburetor, it has been shown that this is enough fuel to initially fire the engine. Once the engine fires, fuel is drawn from the extended prime fuel chamber 62 through passage 74 because of the pressure difference. Fuel drawn from chamber 62 to throat 34 will continue until extended prime fuel chamber 62 is empty.

After the enrichment period, the carburetor 10 will return to a lower carbon monoxide percentage. This is due to the flow of air through the extended prime chamber 62 when the level of fuel within chamber 62 falls below the level of the outlet of passage 74. This therefore prevents fuel from traveling up fill passage 68 from carburetor bowl 16 and, in turn, prevents fuel from traveling up extended prime fuel passage 74, resulting in a higher air/fuel ratio and, thus, lowering the carbon monoxide percentage.

Figure 2:
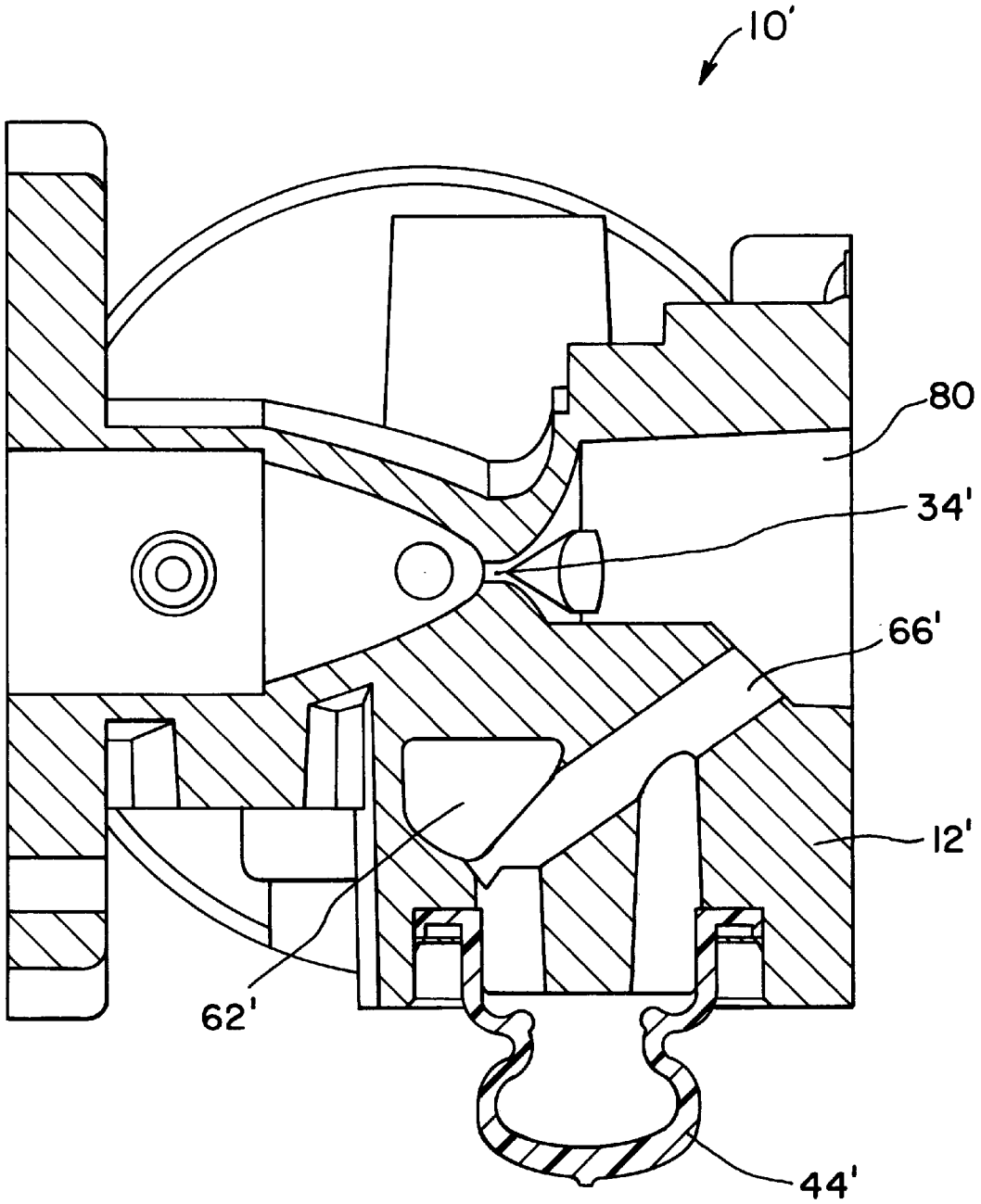
FIG. 2 is a horizontal sectional view of a carburetor body of a second embodiment.

FIG. 2 illustrates a second embodiment of the present invention showing a carburetor 10' having a primer chamber vent passage 66' extending from extended prime fuel chamber 62' to a larger diameter area 80 of the carburetor throat and also to a primer bulb 44'. Primer chamber vent passage 66' communicates with a carburetor bowl through a primer bulb 44' by the priming passage (not shown) in order to achieve the bowl venting described earlier. The primer chamber vent passage 66' replaces the throat vent passage 66 and the internal breather vent passage 52 of the first embodiment, and the remaining members of the first embodiment are incorporated in the second embodiment. The diameter of carburetor throat or venturi 34' appears much narrower in FIG. 2 than it is in reality because of the place at which the section of FIG. 2 was taken.

Figure 3:
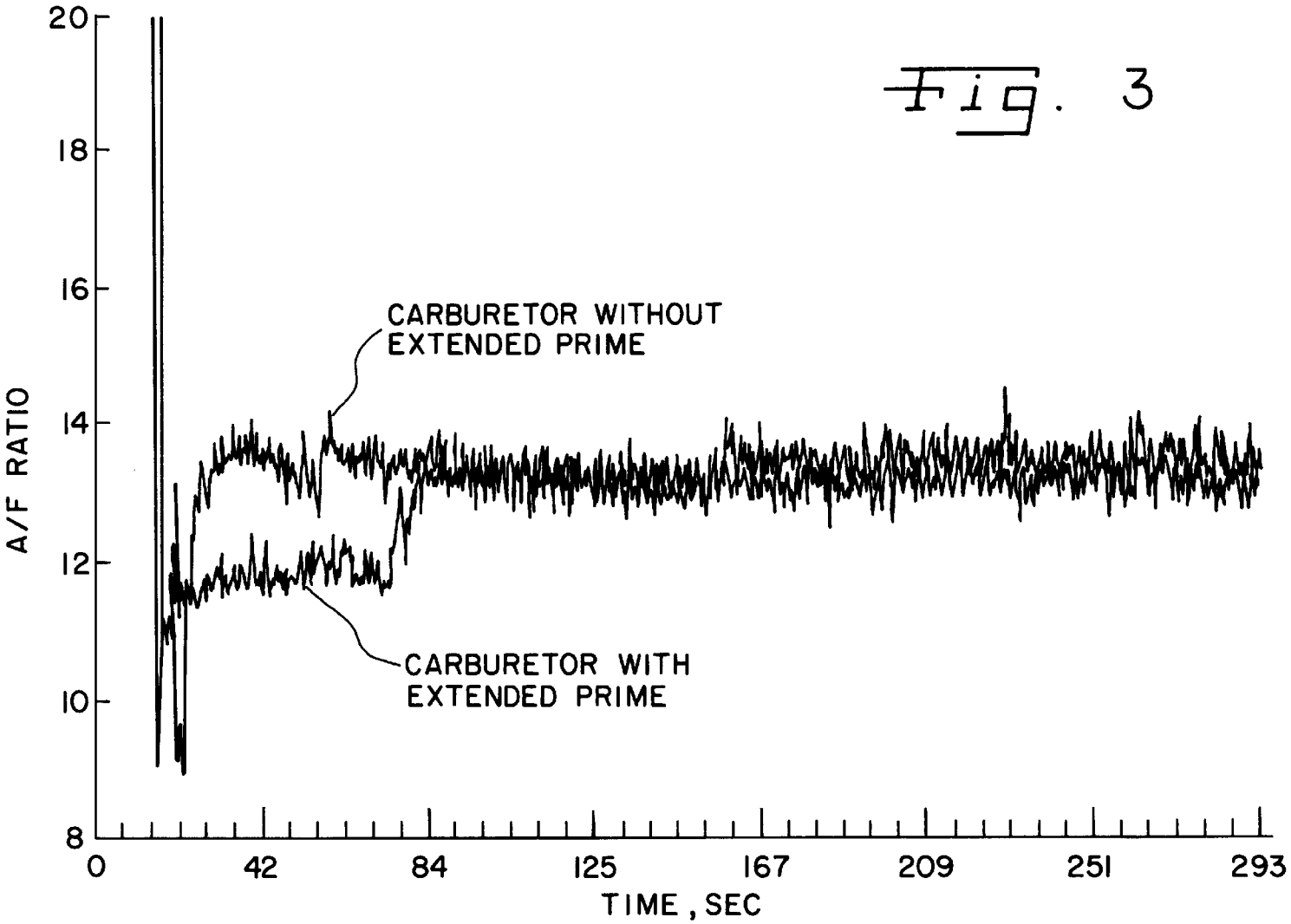
FIG. 3 is a graph illustrating the air/fuel mixture ratio for an existing production carburetor and the same carburetor provided with the extended prime system shown in FIG. 1.

FIG. 3 illustrates the lower air/fuel ratio during the extended prime compared to a carburetor that is not provided with the extended prime chamber of the present invention. Once the extended prime fuel chamber has been emptied of fuel, however, both carburetors function similarly under relatively lean conditions producing acceptable levels of carbon monoxide.

Figure 4:
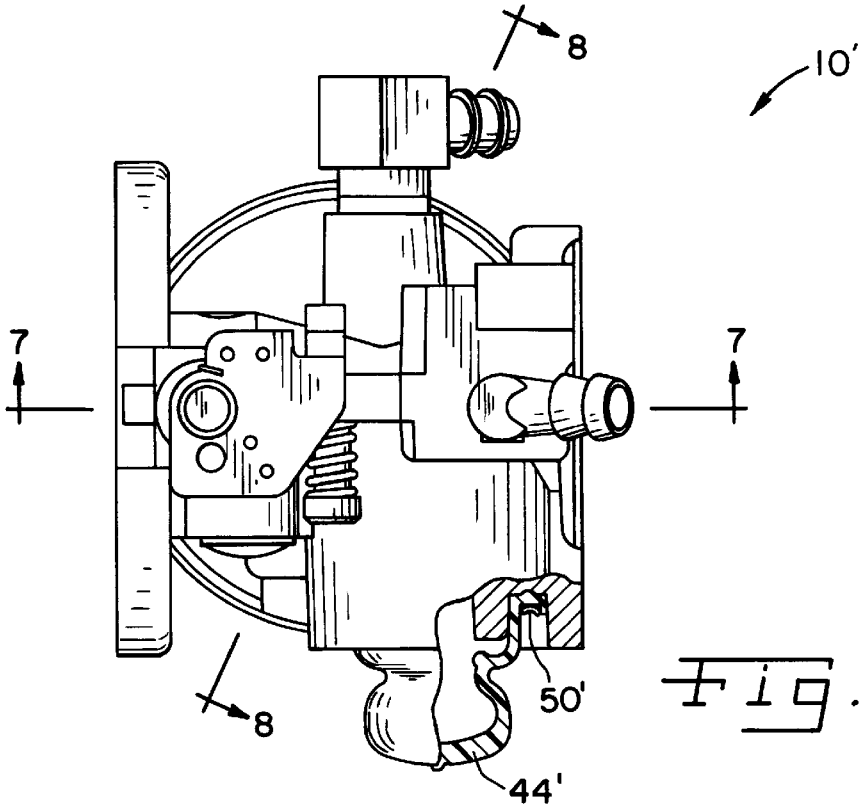
FIG. 4 is a top view shown partially in section further illustrating the second embodiment incorporating the present invention.
Figure 5:
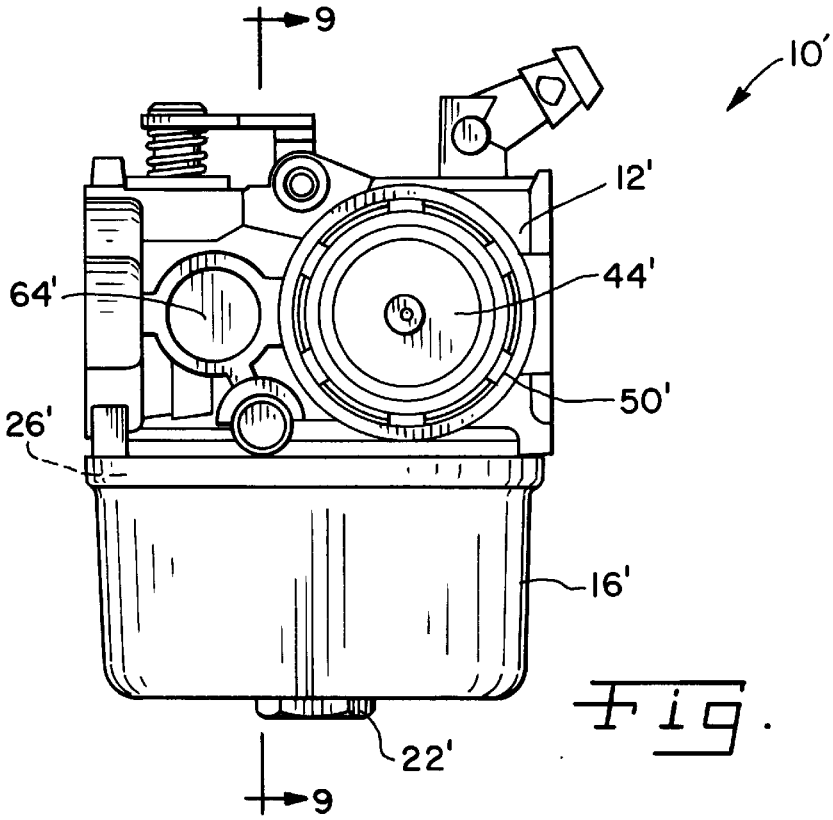
FIG. 5 is a side view of the second embodiment of the present invention.
Figure 6:
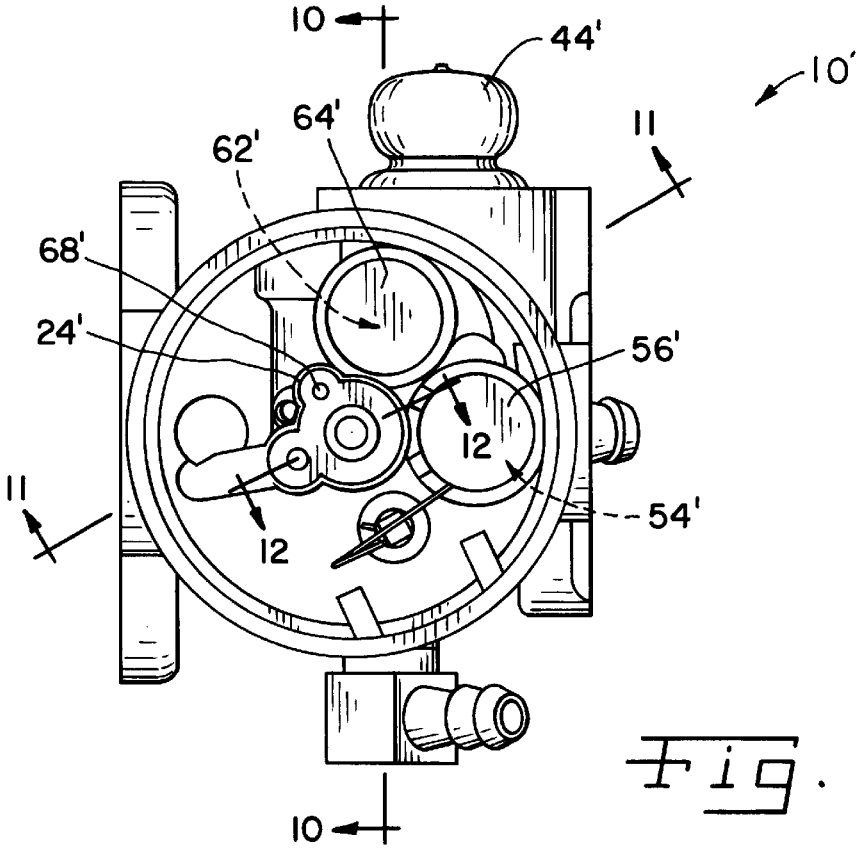
FIG. 6 is a bottom view shown partially in section further illustrating the second embodiment, the carburetor bowl removed.
Figure 7:
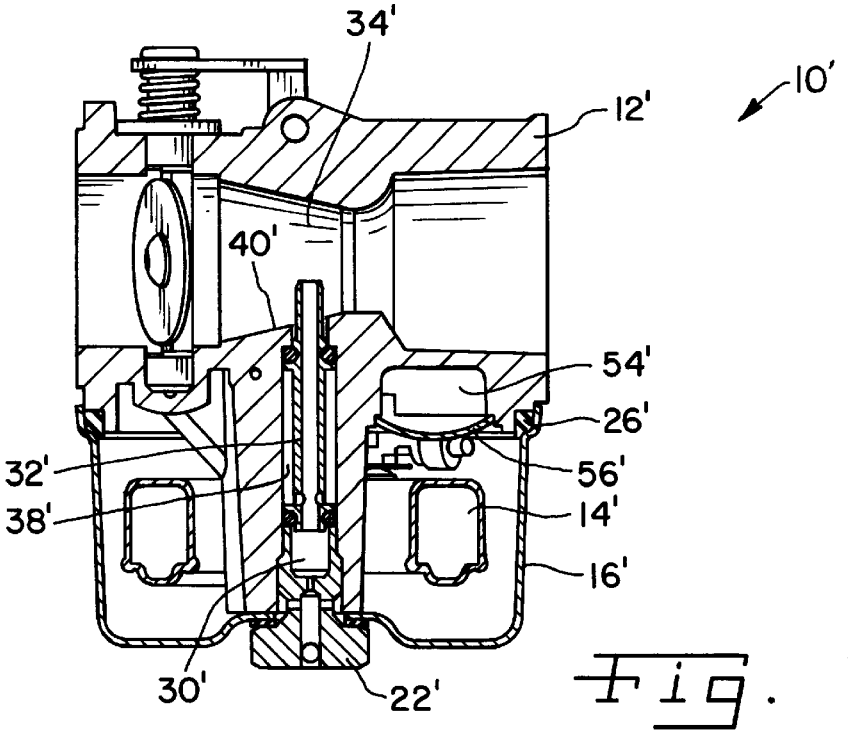
FIG. 7 is a sectional view taken along line 7—7 of FIG. 4 viewed in the direction of the arrows illustrating the second embodiment.
Figure 8:
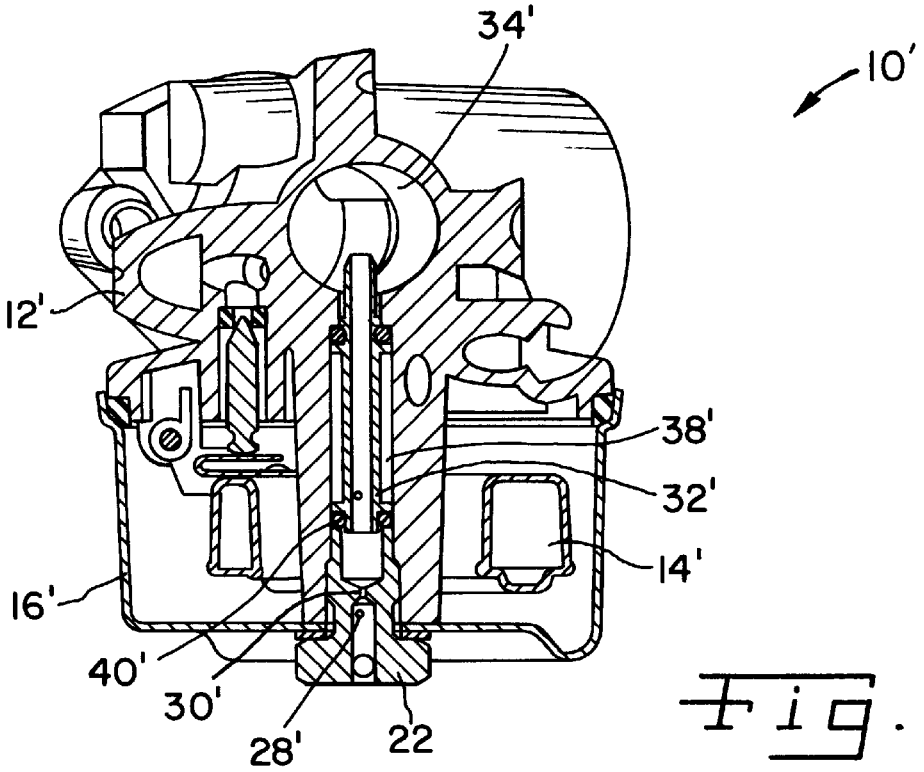
FIG. 8 is a sectional view taken along line 8—8 of FIG. 4 viewed in the direction of the arrows illustrating the second embodiment.
Figure 9:
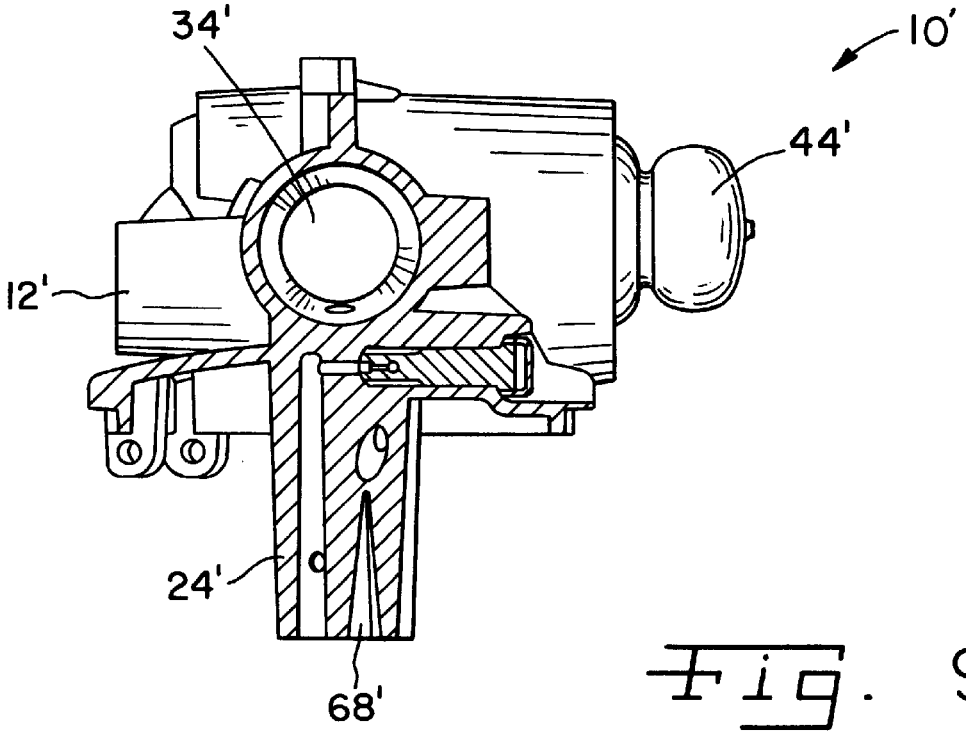
FIG. 9 is a sectional view taken along line 9—9 of FIG. 5 viewed in the direction of the arrows illustrating the second embodiment, the carburetor bowl removed.
Figure 10:
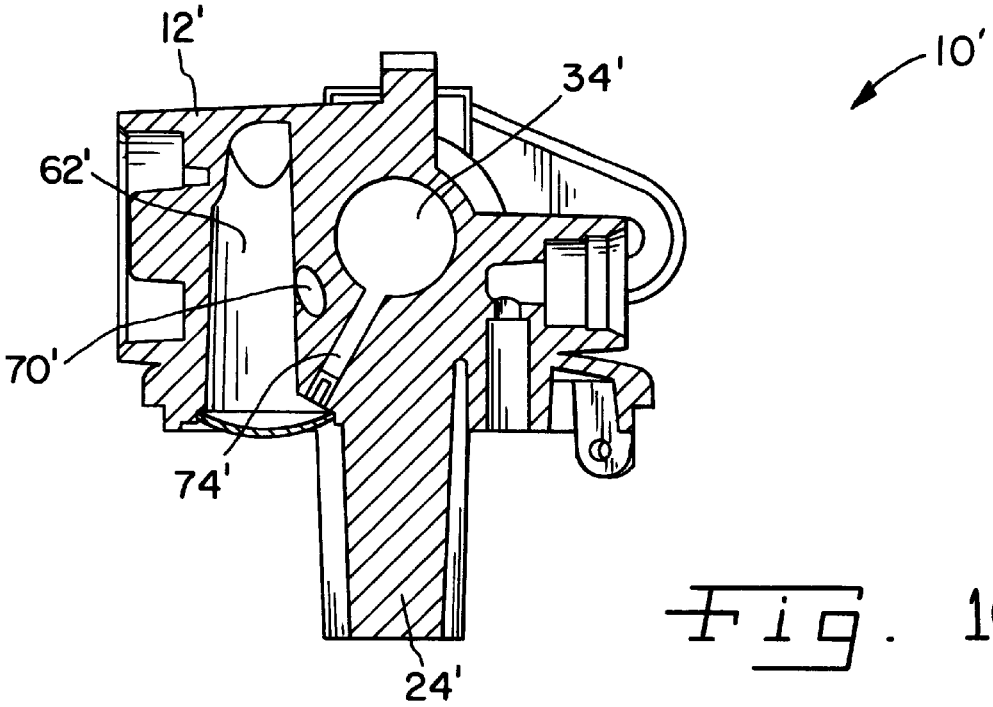
FIG. 10 is a sectional view taken along line 10—10 of FIG. 6 viewed in the direction of the arrows illustrating the second embodiment.
Figure 11:
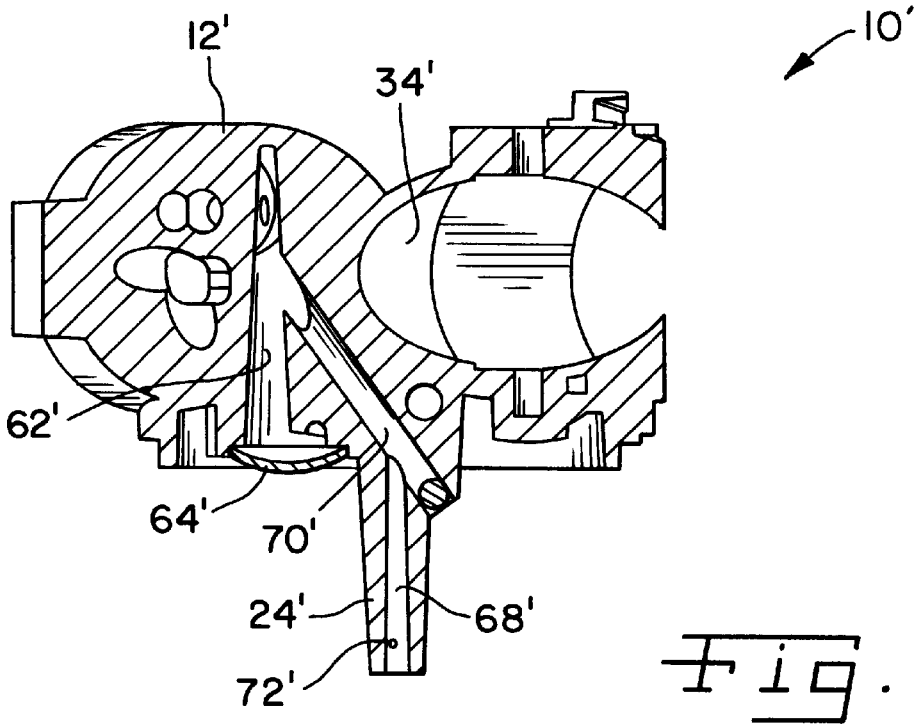
FIG. 11 is a sectional view taken along line 11—11 of FIG. 6 viewed in the direction of the arrows illustrating the second embodiment.
Figure 12:
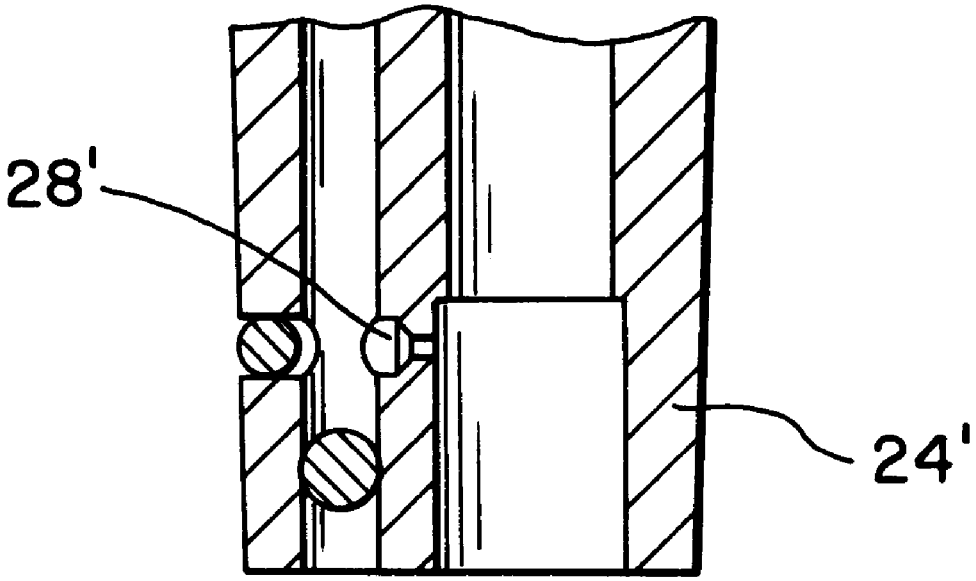
FIG. 12 is a side view shown partially in section of a hollow columnar portion of the second embodiment of the present invention.

FIGS. 4–12 further illustrate the second embodiment incorporating the present invention showing a carburetor 10' having an extended prime. The reference characters provided in FIGS. 4–12 are labeled with prime numbers which correspond to the reference characters of FIG. 1. FIGS. 4 and 6 respectively depict top and bottom views partially in section further illustrating the second embodiment. FIG. 4 particularly illustrates a primer bulb 44' and a retaining ring 50'. FIGS. 5 shows a side view of the second embodiment. FIG. 5 particularly illustrates a welch plug 64'. FIG. 7 and FIG. 8 depict sectional views of the second embodiment taken along lines 7—7 and 8—8 respectively of FIG. 4 viewed in the direction of the arrows. FIG. 9 shows a sectional view of the carburetor body taken along line 9—9 of FIG. 5 viewed in the direction of the arrows illustrating the second embodiment. FIGS. 10–11 further depict sectional views of the carburetor body. FIG. 12 depicts a side view shown partially in section of the hollow columnar portion 24'. Hollow columnar portion 24' is shown in relation to orifice 28'.

The extended prime also functions in a carburetor provided with a choke plate rather than a primer chamber. In a choke carburetor, the choke plate (not shown) can create a pressure differential between extended prime fuel chamber and the carburetor bowl sufficient to draw fuel up fuel fill passage to fill chamber. Fuel fill passage must be properly positioned relative to the choke plate to create the differential in pressure while the choke plate is in the choke position. The extended prime feature would replace the need for the choke to be partially applied during engine warm up after initial start up. The extended prime feature would minimize failure by the operator to move the choke from partial to full off position.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A carburetor comprising:

a carburetor body having a throat defining an air/fuel passage extending through said carburetor body;

a fuel bowl connected to said carburetor body;

a conduit for conveying fuel from said bowl to said throat, said conduit extending from said fuel bowl to said carburetor throat;

a variable volume primer chamber communicating with said bowl through a priming passage; and an extended prime fuel chamber communicating with said carburetor throat through an extended prime fuel passage and communicating with said fuel bowl through a fuel fill passage, said extended prime fuel passage connecting to said extended prime fuel chamber at a lower position than the point at which said fuel fill passage connects to said extended prime fuel chamber;

whereby repeated actuations of said variable volume primer chamber forces fuel from said bowl into said carburetor throat and into said extended prime fuel chamber, fuel in said extended prime fuel chamber being drawn into said throat for a limited period of time after engine startup.

2. The carburetor of claim 1, wherein said conduit communicates with said fuel bowl through a nozzle tube orifice, and wherein said fuel fill passage communicates with said fuel bowl through a metering orifice having a predetermined size thereby providing a predetermined fuel ratio to pass through said fuel fill passage and said conduit during priming.

3. The carburetor of claim 2, wherein said predetermined fuel ratio is an equal ratio.

4. The carburetor of claim 1, further including a throat vent passage that extends from said throat to an internal breather vent passage, said internal breather vent passage communicating with said bowl.

5. The carburetor of claim 4, wherein said variable volume primer chamber includes a cavity over which a flexible bulb is disposed and wherein said priming passage extends from said cavity to said fuel bowl, said cavity formed in said carburetor body, said bulb defining a portion of said variable volume primer chamber, said bulb being adapted to be depressed to abruptly vary the volume of said chamber and displace a volume of air from said chamber into said bowl.

6. The carburetor of claim 5, wherein said bulb is resilient, whereby the resiliency of said bulb causes said variable volume primer chamber to return to its pre-displaced volume.

7. The carburetor of claim 6, wherein said bulb comprises an annular lip disposed on an inner portion of said bulb and wherein said cavity extends inwardly from a surface disposed on said carburetor body, said annular lip being aligned opposite said surface and having a circumference greater than the circumference of an opening defined by said cavity so that when said bulb is depressed said annular lip engages said surface surrounding said cavity, thereby sealing said internal breather vent passage from the variable volume primer chamber.

8. The carburetor of claim 1, further including a primer chamber vent passage extending from said extended prime fuel chamber to said bowl.

9. The carburetor of claim 8, wherein said variable volume primer chamber includes a cavity over which a flexible bulb is disposed and wherein said priming passage extends from said cavity to said fuel bowl, said cavity formed on said carburetor body, said bulb defining a portion of the periphery of said variable volume primer chamber, said bulb being adapted to be depressed to abruptly vary the volume of said chamber and displace a volume of air from said chamber into said bowl.

10. A carburetor for providing a combustible air/fuel mixture to an internal combustion engine, said carburetor comprising:

a carburetor body having a throat defining an air/fuel passage extending through said carburetor body;

a fuel bowl connected to said carburetor body;

a conduit for conveying fuel from said bowl directly to said throat, said conduit extending from said fuel bowl to said throat, said conduit communicating with said fuel bowl through a nozzle tube orifice;

a variable volume primer chamber communicating with said bowl through a priming passage; and an extended prime fuel chamber formed in said carburetor body separate from said fuel bowl, said extended prime fuel chamber communicating with said carburetor throat through an extended prime fuel passage and communicating with said fuel bowl through a fuel fill passage, said extended prime fuel passage connecting to said extended prime fuel chamber at a position in an upper portion of said extended prime fuel chamber, said fuel fill passage connecting to said extended prime fuel chamber at a position in a lower portion of said extended prime fuel chamber, said fuel fill passage communicating with said fuel bowl through a metering orifice having a predetermined size thereby providing a predetermined fuel ratio to pass through said fuel fill passage and said conduit during priming, whereby repeated actuations of said variable volume primer chamber forces fuel from said bowl into said throat and into said extended prime fuel chamber, fuel in said extended prime fuel chamber being drawn into said throat for a limited period of time after engine startup.

11. The carburetor of claim 10, wherein said predetermined fuel ratio is an equal ratio.

12. The carburetor of claim 10, further including a throat vent passage that extends from said throat to a breather vent passage.

13. The carburetor of claim 12, wherein said variable volume primer chamber includes a cavity over which a flexible bulb is disposed, said priming passage extending from said cavity to said fuel bowl, said cavity formed in said carburetor body, said bulb defining a portion of the periphery of said variable volume primer chamber, said bulb being adapted to be depressed to abruptly vary the volume of said primer chamber and displace a volume of air from said primer chamber into said bowl.

14. The carburetor of claim 10, further including a primer chamber vent passage that extends from said extended prime fuel chamber to said throat and to an internal breather vent.

15. A carburetor comprising:

a carburetor body having a throat defining an air/fuel passage extending through said carburetor body;

a fuel bowl connected to said carburetor body;

a conduit for conveying fuel from said bowl to said throat, said conduit extending from said fuel bowl to said carburetor throat;

a variable volume primer chamber communicating with said bowl through a priming passage; and an extended prime fuel chamber communicating with said carburetor throat through an extended prime fuel passage and communicating with said fuel bowl through a fuel fill passage;

whereby repeated actuations of said variable volume primer chamber forces fuel from said bowl into said carburetor throat and into said extended prime fuel chamber, fuel in said extended prime fuel chamber being drawn into said throat for a limited period of time after engine startup.

16. The carburetor of claim 15, wherein said conduit communicates with said fuel bowl through a nozzle tube orifice, and wherein said fuel fill passage communicates with said fuel bowl through a metering orifice having a predetermined size thereby providing a predetermined fuel ratio to pass through said fuel fill passage and said conduit during priming.

* * * * *